US005131317A

United States Patent [19]

Meller

[11] Patent Number: 5,131,317

[45] Date of Patent: Jul. 21, 1992

[54] PISTOL WITH AUTOMATIC MECHANISM FOR THE RELEASE OF A SLIDE CATCH

[75] Inventor: Yehuda Meller, Holon, Israel

[73] Assignee: Israeli Military Industries, Ltd., Ramat Hasharon, Israel

[21] Appl. No.: 707,111

[22] Filed: May 29, 1991

[30] Foreign Application Priority Data

Jun. 7, 1990 [IL] Israel ..... 94657

[51] Int. Cl.[5] ..... F41A 17/36

[52] U.S. Cl. ..... 89/138

[58] Field of Search ..... 89/137, 138

[56] References Cited

U.S. PATENT DOCUMENTS

| | | | |
|---|---|---|---|
| 903,998 | 11/1908 | Mauser | 89/138 |
| 1,138,376 | 5/1915 | Hammond | 89/138 |
| 1,138,378 | 5/1915 | Hammond | 89/138 |

*Primary Examiner*—Stephen C. Bentley
*Attorney, Agent, or Firm*—Helfgott & Karas

[57] ABSTRACT

A semi-automatic or automatic pistol of the kind that has a slide catch, having an automatic slide catch release mechanism located within the magazine chamber and comprising:

i) a first bar adapted for reciprocation in longitudinal direction and biased into the uppermost position, comprising near the upper end means for pulling the lever from the slide engaging to the slide releasing position;

ii) a second bar normally aligned with said first bar, adapted to reciprocate longitudinally and fitted near its distal end with motion transmission means;

iii) a resilient link linking said first and second bars whereby an additional degree of freedom is imparted to the latter to be swingable out of alignment with said first bar;

iv) an actuator member reciprocable between upper and lower positions and which in the lower position projects partly out of the magazine chamber, there being provided stop means for arresting the actuator in its lower position; and v) a swingable pawl pivoted intermediary between two end portions one of which bears on said actuator member and the other cooperates with said motion transmission means of said second bar, which pawl is biased into an uppermost position.

4 Claims, 7 Drawing Sheets

PISTOL WITH AUTOMATIC MECHANISM FOR THE RELEASE OF A SLIDE CATCH

FIELD OF THE INVENTION

The present invention relates to a semi-automatic and automatic pistol and concerns more specifically an improvement in the slide catch mechanism thereof.

During operation of a pistol the slide, also known as breech-block, slides forth and back between an advanced firing position and a cocked rear position. The forward movement is brought about by the expansion of so-called recoil springs and during this movement the slide strips a cartridge from the magazine and inserts it into the breech whereupon the cartridge is fired. Upon firing, the propellant gas pressure pushes the slide rearward whereby the recoil springs are compressed and the slide is cocked and ready for another firing round. The firing ammunition is supplied from a magazine which holds a limited number of rounds, say 16, and when in the course of operation the magazine is emptied it has to be replaced by a new, loaded one. When the new, loaded magazine has been inserted into the magazine chamber, the pistol has to be cocked again by pulling the slide rearward, whereupon shooting can be resumed.

In a tense pistol firing situation speed is of the essence. Consequently, many pistols of the kind specified comprise a so-called slide catch designed to retain the slide in the cocked, rear position after the last round of a magazine has been fired. Such a slide catch comprises a swingable lever on the outside of the housing adapted to be retained in either of two extreme upper and lower positions and having a finger or the like integral member that projects inside the housing via an opening in which such finger may move up and down. The finger has an integral, upward protruding catch member which in the upper position of the lever engages a suitably shaped notch in the slide. Normally, the slide catch is in its lower, slide releasing position in which the slide can move back and forth unobstructedly. When the last round of ammunition has been fired, the magazine follower lips push the finger from below and raise it into the upper position in which the upward protruding catch member engages the said notch of the slide whereby the latter is retained in the cocked, rear position. Upon insertion of a new, loaded magazine the operator has to lower the magazine catch lever by pressing it from above with his thumb, whereupon the slide is released. This is followed by release of the safety catch whereupon firing may be resumed.

While such state of the art slide catches are quite useful, the need for a special operation in order to reset the catch from the engaging into the releasing position is inherently time consuming, and it is therefore the object of the present invention to provide an improved slide catch by which the catch is reset automatically upon insertion of a magazine.

SUMMARY OF THE INVENTION

In accordance with the present invention there is provided a pistol with a breech holding slide and adapted for shooting ammunition delivered from a magazine accommodated within a magazine chamber and having a spring loaded follower for pushing ammunition towards the breech, the pistol further comprising a slide catch of the kind that comprises a lever with an integral catch member swingable between an upper, slide engaging and a lower, slide releasing position, which lever is biased into the slide releasing position and adapted for being shifted from the slide releasing to the slide engaging position by the magazine follower, characterized by an automatic slide catch release mechanism extending within the magazine chamber between said swingable lever and the bottom region of the magazine chamber, comprising:

i) a first bar adapted for reciprocation in longitudinal direction and biased into the uppermost position, comprising near the upper end means for pulling the lever from the slide engaging to the slide releasing position;

ii) a second bar normally aligned with said first bar, adapted to reciprocate longitudinally and fitted near its distal end with motion transmission means;

iii) a resilient link linking said first and second bars whereby an additional degree of freedom is imparted to the latter to be swingable out of alignment with said first bar;

iv) an actuator member reciprocable between upper and lower positions and which in the lower position projects partly out of the magazine chamber, there being provided stop means for arresting the actuator in its lower position; and v) a swingable pawl pivoted intermediary between two end portions one of which bears on said actuator member and the other cooperates with said motion transmission means of said second bar, which pawl is biased into an uppermost position.

In a preferred embodiment of the invention means are provided in association with said first bar for limiting the extent of longitudinal reciprocation thereof.

In accordance with one embodiment of the invention the said first and second bars and resilient link are three distinct bodies. In accordance with another embodiment the said bars are parts of a single body having a constricted zone which constitutes the said resilient link.

In operation, when the last round of ammunition has been fired from the magazine, the lever of the slide catch is pushed from below by the magazine follower into the upper, slide engaging position whereby the slide is retained in the cocked, rear position. In consequence of the shifting of the slide catch lever into the slide engaging position, the first bar becomes engaged by the lever. When now the empty magazine is withdrawn, the actuator member is free to slide down until it is arrested by said stop means, so that it partly projects out of the magazine chamber. Simultaneously, the pawl is swung into its uppermost position in consequence of the biasing force acting thereon, pushing on its way the second bar which consequently swings out of alignment with the first bar until the motion transmission means of the second bar come to bear on the pawl from below, whereupon the second bar snaps back into alignment with the first bar by the spring action of said resilient link member. When now a new, loaded magazine is inserted into the magazine chamber the base thereof pushes the actuator up, causing the pawl to swing back into its lowermost position and pulling with it the assembly of second bar, link and first bar. Due to the engagement of the first bar with the slide catch lever the latter is pulled down and shifted into the lower, slide releasing position. Thus, the safety catch is automatically released and shooting may be resumed upon release of the safety catch without any need for manipulation of the slide catch.

DESCRIPTION OF THE DRAWINGS

For better understanding, the invention will now be described, by way of example only, in the accompanying drawings without being limited thereto. In the drawings.

DESCRIPTION OF A SPECIFIC EMBODIMENT

Figure 1:
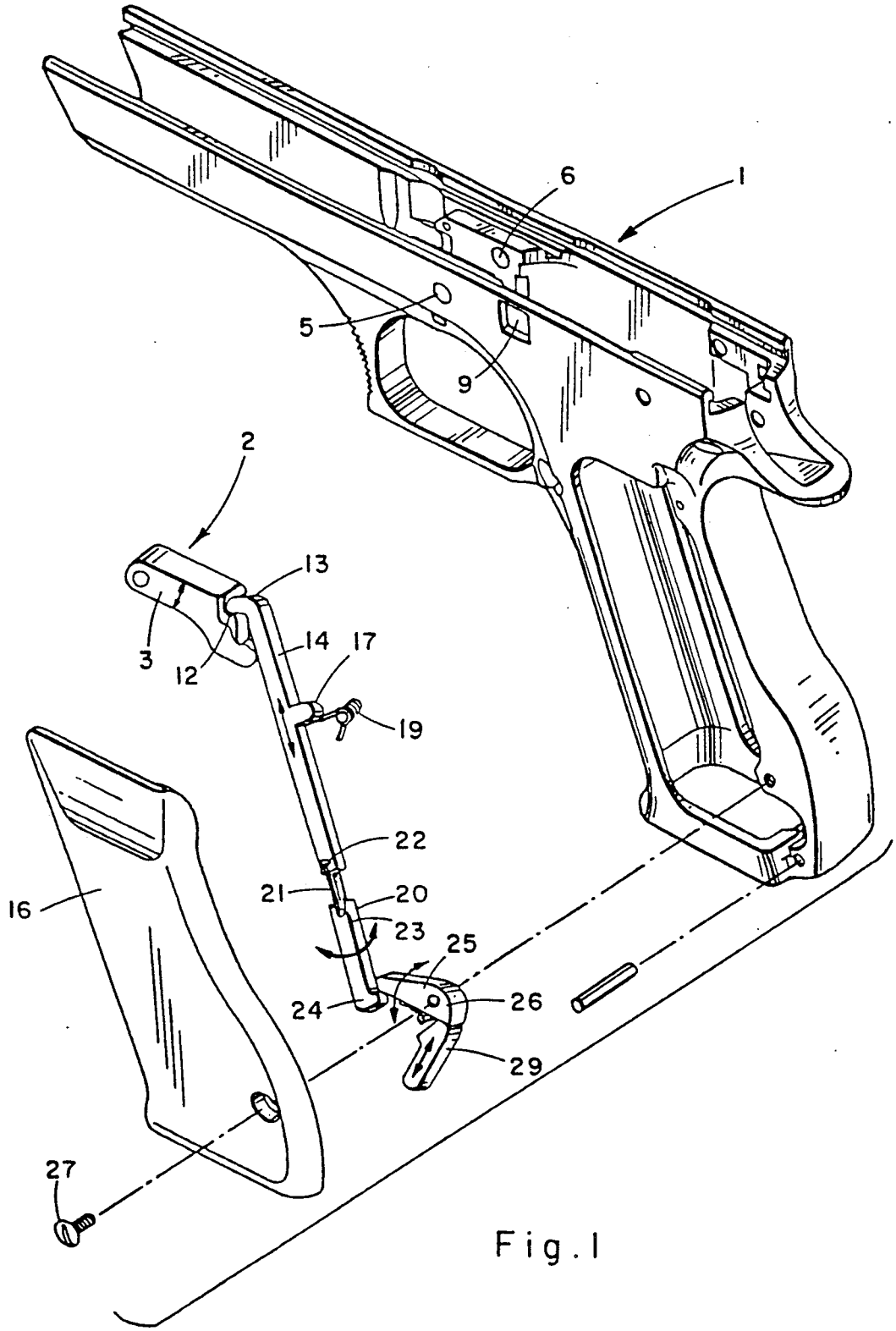
FIG. 1 is an exploded view of a pistol housing with slide catch and automatic slide catch release according to the invention.

As shown in the drawings, a pistol having a housing 1 is fitted with a slide catch 2 comprising a lever 3 with an integral pin 4 adapted for reception by a pair of registering holes 5 and 6. Lever 3 further comprises an integral boss 7 with an upward protruding tooth 8. Boss 7 is adapted for insertion into a rectangular opening 9 in a side wall of the housing which is of a larger size than the boss so that boss 7 can move therein up and down thereby enabling lever 3 to swing between a lower, slide releasing and upper slide engaging position.

Lever 3 of the slide catch 2 has an actuation portion 10 located underneath a cover 11 which in FIG. 1 is removed and which is so shaped that when there occurs a malfunction of the automatic release mechanism, the lever can be shifted manually. As shown, the actuation portion of lever 3 comprises a shoulder 12 designed to be engaged from above by a hook-shaped head portion 13 of a first bar 14. Bar 14 is accommodated in a matching groove 15 in the backside of the near magazine side wall 16, and on its rearside comprises a projection 17 accommodated within a cut-out 18 in which projection 17 can reciprocate. A helical spring member 19 with two terminal arms and accommodated within the magazine side wall 16 acts on projection 18 and thereby biases bar 14 upward.

A second bar 20 is axially spaced from the first bar 14 and is linked thereto by a resilient link 21 connected to the first and second bars 14 and 20 at 22 and 23, respectively. Normally the second bar 20 is in alignment with the first bar 14 but due to the resilience of link 21 it may be pushed out of alignment. The distal end portion 24 of the second bar 20 is hook-shaped and serves for power transmission to and from a pawl 25 pivoted at 26 on a screw 27 by which the magazine side wall 16 is secured in position. The lower face of hook-shaped, power transmission end portion 24 is formed as a gliding surface for cooperation with the upper side of pawl 25 as will be explained below.

An actuator 29 is adapted to reciprocate within a groove 30 on the inner side of magazine side wall 16. Actuator 29 has a stepped portion 31 adapted for cooperation with a shoulder 32 of side wall 16 whereby actuator 29 is arrested in its lower position. A helical spring 33 with two terminal arms biases pawl 25 into the uppermost state shown in FIG. 6.

Figure 3:
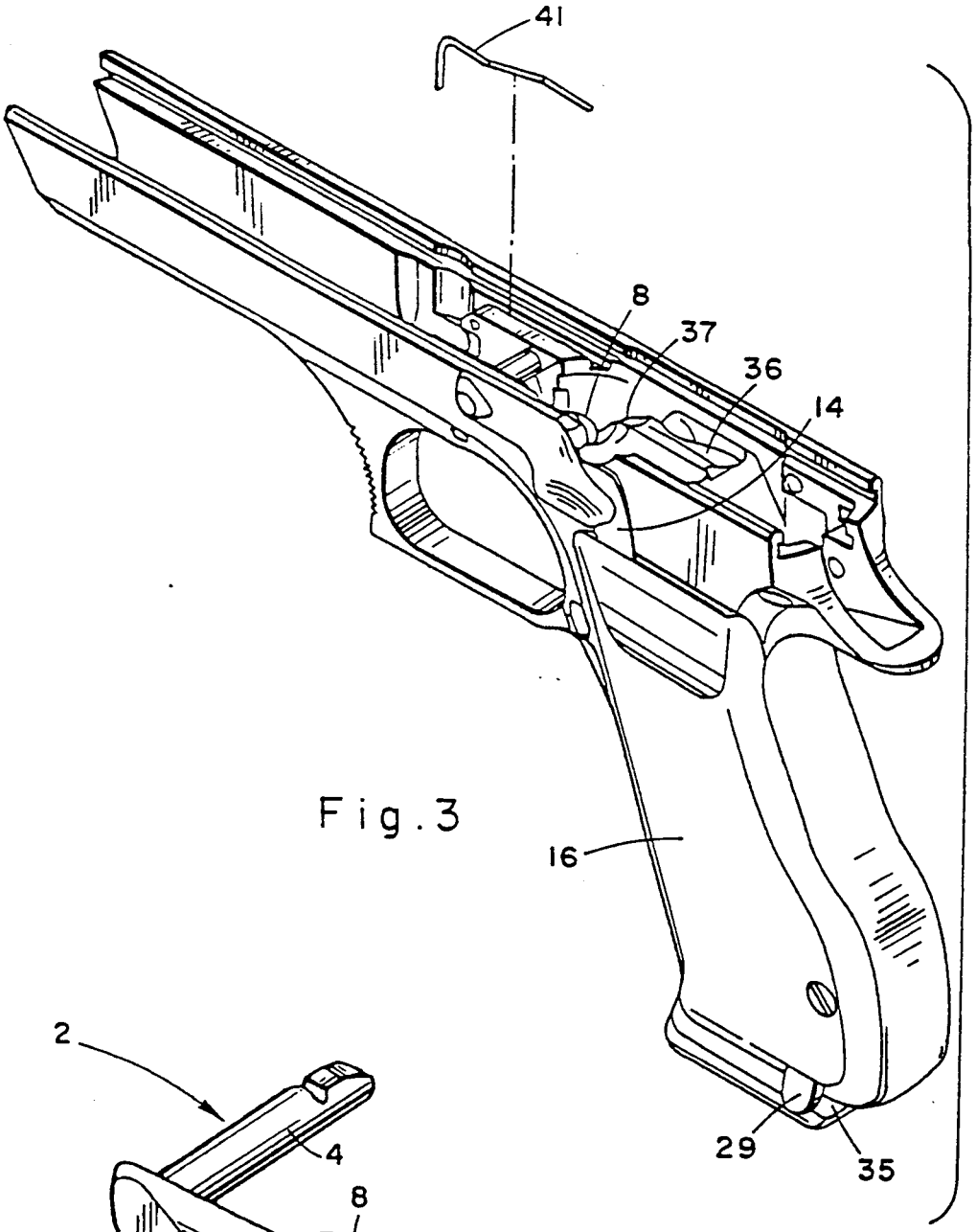
FIG. 3 is a perspective view of the pistol housing with magazine, slide catch and slide catch releasing mechanism in position.
Figure 2:
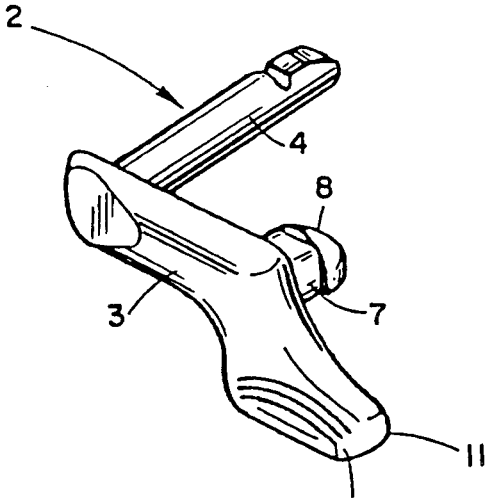
FIG. 2 is a perspective view of the slide catch of FIG. 1.
Figure 4:
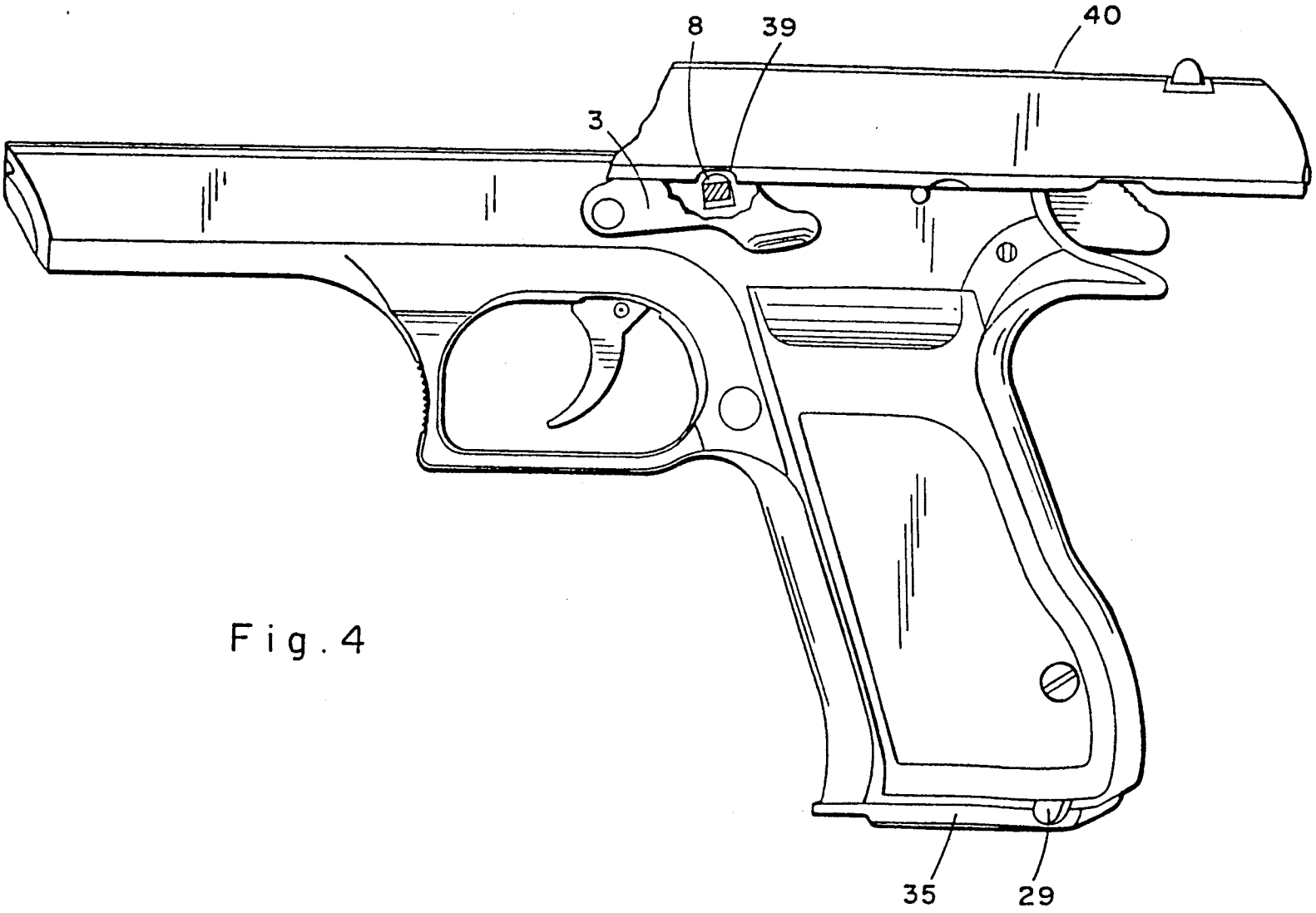
FIG. 4 is an elevation, partially broken open and showing the slide catch in the upper, slide engaging position.

FIG. 3 shows how the magazine base 35 cooperates with the lower portion of actuator 29. FIGS. 3 and 4 further show how a lip 37 of magazine follower 36 engages boss 7 from below to lift lever 3 of the slide catch into the upper, slide engaging position in which tooth 8 engages a notch 39 of slide 40 in the cocked, rear position of the latter.

Finally, FIG. 3 also shows in an exploded fashion a wire spring 41 which engages boss 7 of slide catch lever 3 in a manner known per se and not shown, so as to bias it into the lower, slide releasing position.

Figure 5:
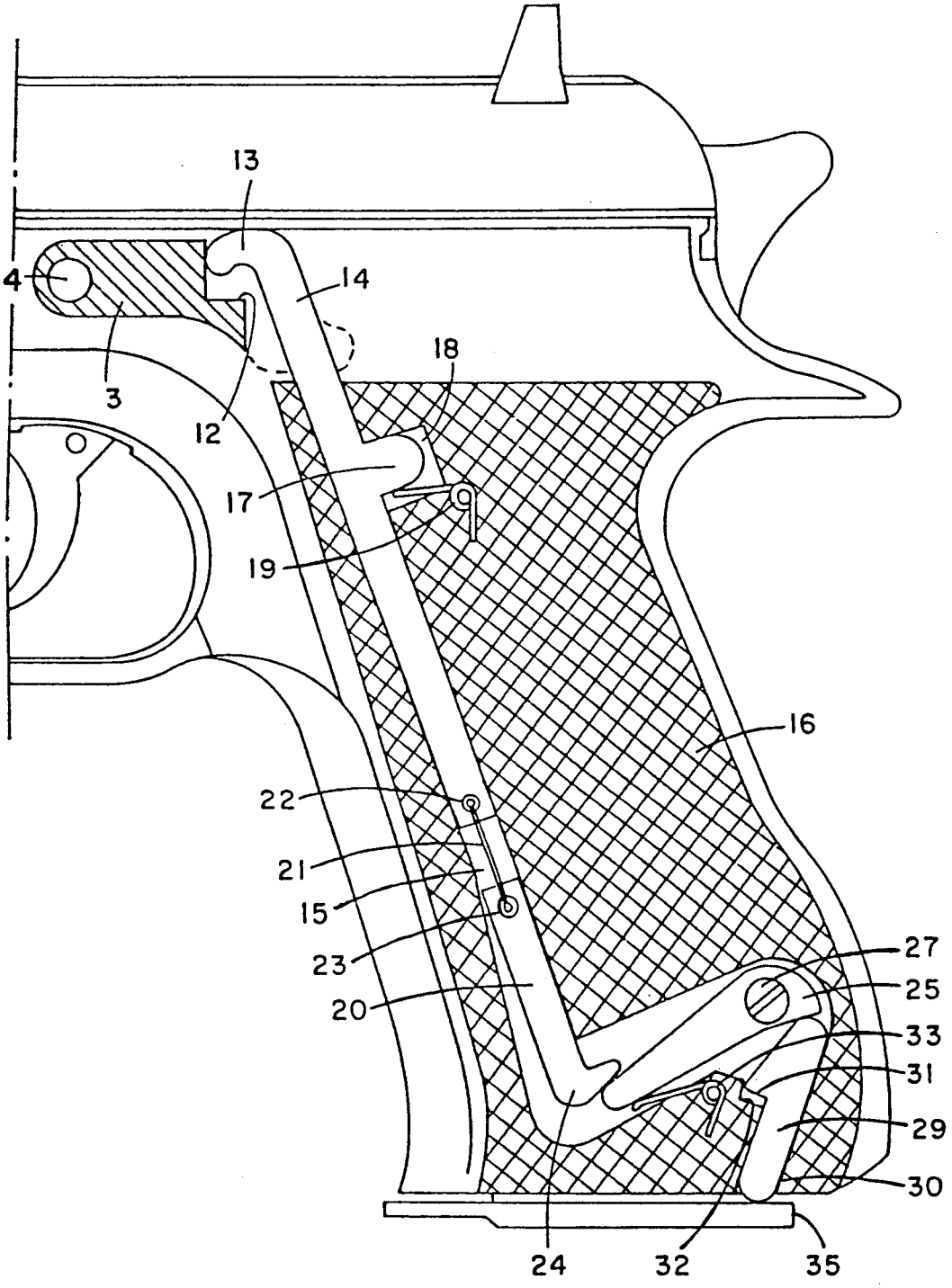
FIG. 5 is an elevation of the slide catch and slide catch release mechanism in the lower, slide releasing position.
Figure 6:
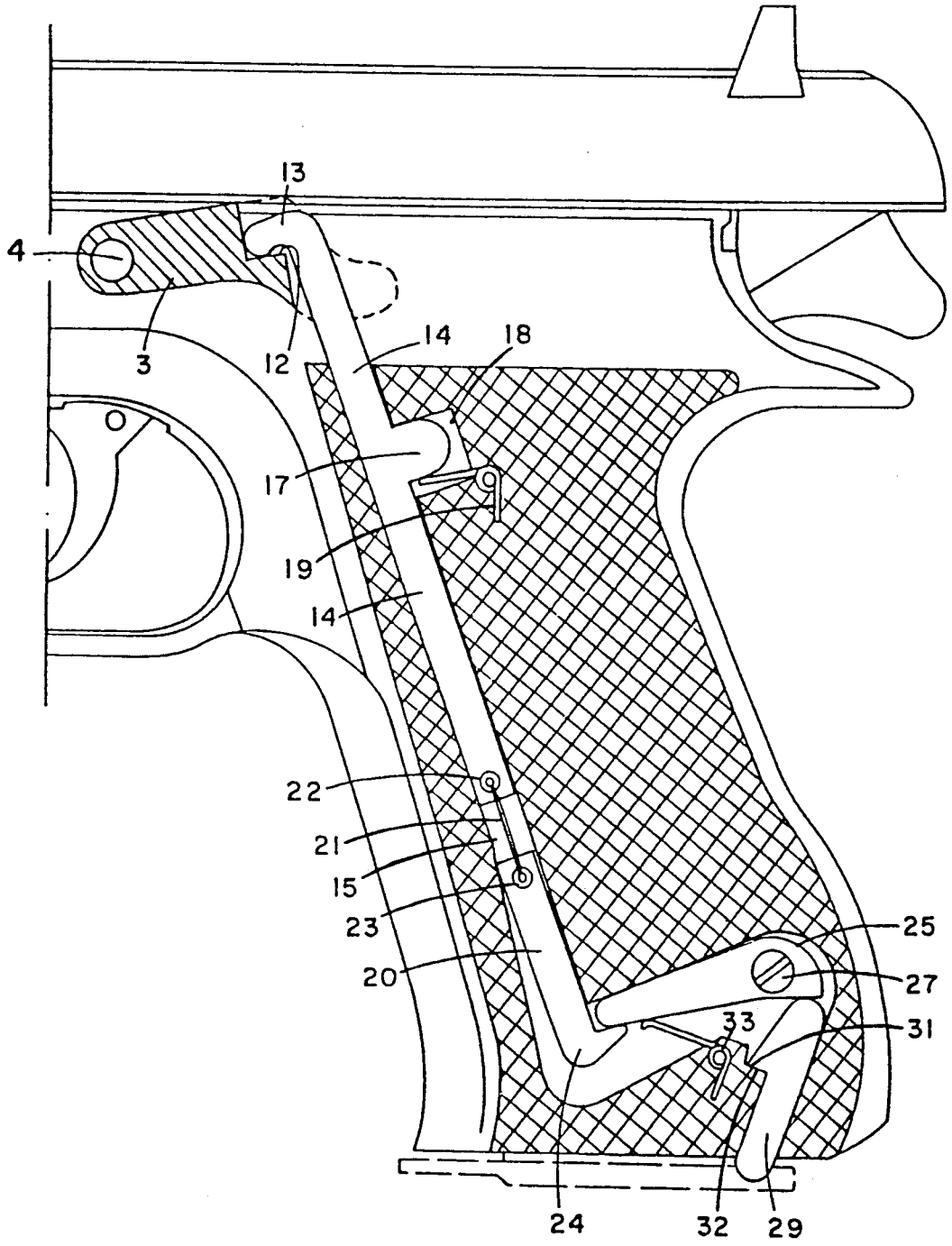
FIG. 6 is a similar elevation in the slide engaging position.
Figure 7:
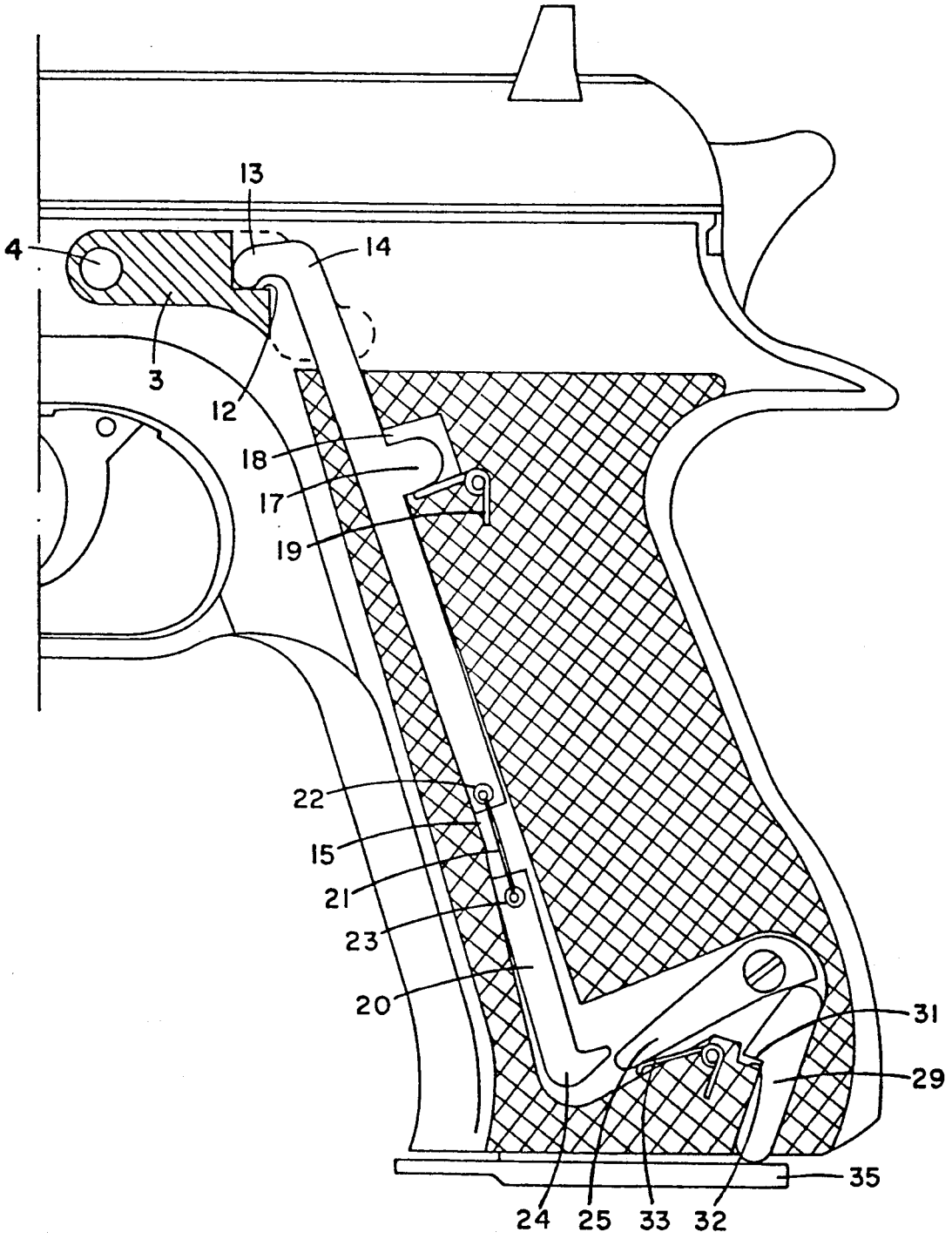
FIG. 7 is a similar elevation at the end of the automatic slide catch release.

The operation of the automatic slide catch release according to the invention will now be explained with reference to FIGS. 5 to 7. In FIG. 5 the slide catch is in the lower, slide releasinq position in which it is retained by the action of spring 41. Bar 14 is kept in its uppermost position by the action of spring 19, pawl 25 is in its lowermost position in which its extreme end is underneath the power transmitting end portion 24 of bar 20 and is retained in that position against the biasing action of spring 33 because of the retracted position of actuator 29 into which it is forced by the magazine base 35. When the last round of the magazine has been fired, lever 3 is lifted by lip 37 of magazine follower 36 into the upper, slide engaging position shown in FIGS. 4 and 6. When now the empty magazine is withdrawn so that the magazine base 35 no longer arrests actuator 29, spring 33 pushes pawl 25 upward whereby the upper edge thereof glides along the lower gliding surface of the power transmitting end portion 24 causing bar 20 to swing clockwise out of alignment with bar 14 and against the action of resilient link 21, thereby to clear the way for pawl 25 to snap into the uppermost position shown in FIG. 6, whereupon link 21 drives bar 20 back into its normal position of alignment with bar 14, as also shown in FIG. 6. Actuator 29 is thereby pushed down until the stepped portion 31 abuts shoulder 32.

Upon insertion of a new, loaded magazine, the base plate 35 thereof pushes actuator 29 up whereupon pawl 25 swings down pulling with it bar 20, link 21 and bar 14 into the lowermost position of the latter in which the projection 17 abuts the lower side wall of cut-out 18. In consequence of the pressure exerted by pawl 25 bar 20 is again pushed clockwise out of alignment with bar 14 until it clears the pawl 25 as shown in FIG. 7, whereupon spring 19 drives bar 14 and with it link 15 and bar 20 back into the starting position of FIG. 5.

During all that time the slide was retained in the cocked, rear position ready for firing. Upon release of the safety catch, firing is resumed.

Figure 8:
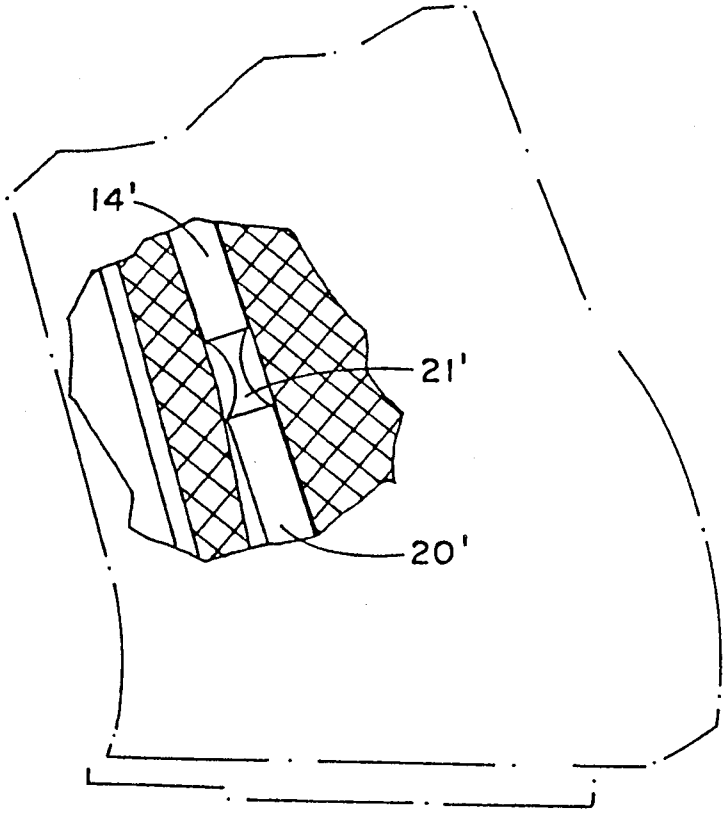
FIG. 8 is a fractional elevation of another embodiment of the slide catch mechanism.

In the embodiment of FIG. 8 the first bar 14' and the second bar 20' form part of one single body having a constricted portion 21' that constitutes the resilient link between the two. For the rest, this embodiment is the same as that of FIGS. 1 to 7 and functions in the same way.

I claim:

1. A pistol with a breech holding slide and adapted for shooting ammunition delivered from a magazine accommodated within a magazine chamber and having a spring loaded follower for pushing ammunition towards the breech, the pistol further comprising a slide catch of the kind that comprises a lever with an integral catch member swingable between an upper, slide engaging and a lower, slide releasing position, which lever is biased into the slide releasing position and adapted for being shifted from the slide releasing to the slide engaging position by the magazine follower, characterized by an automatic slide catch release mechanism extending within the magazine chamber between said swingable lever and the bottom region of the magazine chamber, comprising:

i) a first bar adapted for reciprocation in longitudinal direction and biased into the uppermost position, comprising near the upper end means for pulling the lever from the slide engaging to the slide releasing position;

ii) a second bar normally aligned with said first bar, adapted to reciprocate longitudinally and fitted near its distal end with motion transmission means;

iii) a resilient link linking said first and second bars whereby an additional degree of freedom is imparted to the latter to be swingable out of alignment with said first bar;

iv) an actuator member reciprocable between upper and lower positions and which in the lower position projects partly out of the magazine chamber, there being provided stop means for arresting the actuator in its lower position; and v) a swingable pawl pivoted intermediary between two end portions one of which bears on said actuator member and the other cooperates with said motion transmission means of said second bar, which pawl is biased into an uppermost position.

2. A pistol according to claim 1 comprising means for limiting the longitudinal reciprocation of said first bar.

3. A pistol according to claim 1, characterized in that the first bar, second bar and resilient link are three distinct bodies.

4. A pistol according to claim 1, characterized in that said first bar and second bar form part of one single body having a constricted portion that constitutes said resilient link.

* * * * *